US009041613B1

(12) United States Patent
Lin et al.

(10) Patent No.: US 9,041,613 B1
(45) Date of Patent: May 26, 2015

(54) HIGH GAIN DISH ANTENNA WITH A TAPERED SLOT FEED

(71) Applicants: Leon Yong Lin, San Diego, CA (US); Steve Edward Mancewicz, San Diego, CA (US); Bruce Daniel Calder, San Diego, CA (US); Robbi Mangra, San Diego, CA (US); Hale Bradford Simonds, Santee, CA (US); Patrick Albert Groves, San Diego, CA (US)

(72) Inventors: Leon Yong Lin, San Diego, CA (US); Steve Edward Mancewicz, San Diego, CA (US); Bruce Daniel Calder, San Diego, CA (US); Robbi Mangra, San Diego, CA (US); Hale Bradford Simonds, Santee, CA (US); Patrick Albert Groves, San Diego, CA (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 260 days.

(21) Appl. No.: 13/861,127

(22) Filed: Apr. 11, 2013

(51) Int. Cl.
*H01Q 13/10* (2006.01)
*H01Q 15/16* (2006.01)

(52) U.S. Cl.
CPC ..... *H01Q 13/106* (2013.01); *H01Q 15/16* (2013.01)

(58) Field of Classification Search
CPC ..... H01Q 13/10
USPC ..... 343/767, 840, 711
See application file for complete search history.

(56) References Cited

U.S. PATENT DOCUMENTS

| | | | | |
|---|---|---|---|---|
| 5,583,511 | A * | 12/1996 | Hulderman | 342/175 |
| 6,317,094 | B1 * | 11/2001 | Wu et al. | 343/767 |
| 7,397,440 | B1 | 7/2008 | Horner et al. | |
| 7,773,043 | B1 | 8/2010 | Horner et al. | |
| 2005/0007286 | A1 * | 1/2005 | Trott et al. | 343/770 |
| 2005/0162332 | A1 * | 7/2005 | Schantz | 343/795 |
| 2006/0092086 | A1 * | 5/2006 | Franson et al. | 343/767 |
| 2010/0149061 | A1 * | 6/2010 | Haziza | 343/779 |
| 2010/0283701 | A1 * | 11/2010 | Cheng et al. | 343/793 |
| 2012/0326939 | A1 * | 12/2012 | Cannon et al. | 343/840 |

OTHER PUBLICATIONS

Giri, D.V., "Radiation of Impulse-Like Waveforms With Illustrative Applications", Ultra Wideband and Ultra Short IMpulse Signals, Sep. 19-22, All, Sevastopol, Ukraine.

Dubrovka, F.F. et al., "An Ultrawidebrand 1-20 GHz Modified Log-Periodic Feed", Ultra Wideband and Ultra Short IMpulse Signals, Sep. 6-10, 2010, All, Sevastopol, Ukraine.

Volakis et al., "Small Antennas Miniaturization Technique and Application", pp. 234-240, McGraw Hill, New York.

(Continued)

*Primary Examiner* — Huedung Mancuso

(74) *Attorney, Agent, or Firm* — SSC Pacific Patent Office; Arthur K. Samora; Kyle Eppele

(57) ABSTRACT

A broadband antenna can include a parabolic dish having a diameter D and a radius of curvature that establishes a focal point for the parabolic dish. A tapered slot feed having a feed point can be positioned above the parabolic dish so that its effective radiation point is spaced a distance F from the center of the dish, where F is the focal length of the dish. With this configuration, feed point for the tapered slot feed can be coincident with parabolic dish focal point. The tapered slot feed can include two elements that form an exponentially tapered slot, which establishes a phase center for the tapered slot feed. A conductive bar can interconnect the two elements, in order to minimize the phase center variation during broadband operation.

7 Claims, 4 Drawing Sheets

(56) References Cited

OTHER PUBLICATIONS

Schantz, Hans, "The Art and Science of Ultrawidebrand Antennas", All, Artech House, Boston/London, 2005.

Maaskant, R. et al, "An Analysis of Large Microstrip-Fed Tapered Slot Antenna Arrays by Combining Electrodynamics and Quasi-Static Field Models", pp. 1798-1806, IEEE Antennas and Propogation, vol. 59, No. 6, Jun. 2011.

* cited by examiner

HIGH GAIN DISH ANTENNA WITH A TAPERED SLOT FEED

FEDERALLY-SPONSORED RESEARCH AND DEVELOPMENT

This invention (Navy Case No. 101674) is assigned to the United States Government and is available for licensing for commercial purposes. Licensing and technical inquires may be directed to the Office of Research and Technical Applications, Space and Naval Warfare Systems Center, Pacific, Code 72120, San Diego, Calif. 92152; voice (619) 553-5118; email ssc_pac_T2@navy.mil.

FIELD OF THE INVENTION

The present invention pertains generally to antennas. More specifically, the present invention pertains to dish antennas which can be designed for broadband applications. The invention is particularly, but not exclusively, useful as a dish antenna with a tapered slot feed, which results in a high gain narrow beam antenna with the capability to operate over a wide bandwidth in a high power continuous wave (CW) mode.

BACKGROUND OF THE INVENTION

By geometrical optics, an ideal dish antenna requires a parabolic reflector, and a point radiation source at the focal point of the reflector. Such an antenna has gain (directivity) that is proportional to its diameter when illuminated properly. However, in practice the bandwidth and power handling of a high-gain dish antenna is dependent on the bandwidth and power handling of its respective feed element. This is particularly true at the low end of the frequency range. For many dish antennas, the lowest operational frequency can be determined by the dish diameter. For this invention, the dish diameter is only limited by operational constraints. The bandwidth of the dish can also be limited by the bandwidth of the feed element. The feeds for such high-power, high-gain, very broadband dish antennas must meet several requirements. First, the feed design must meet the bandwidth requirements. Second, the feed design must have minimum variation of the location of its phase center in respect to the focal point of the dish over the entire design bandwidth (a constant phase center). Third, the width of the beam pattern must match the dish size over the entire desired frequency range. Fourth, the feed must be able to transmit at the required power levels.

Several types of feed antennas have been researched. A flat exponential spiral feed element may have a wide bandwidth and a constant fixed phase center, however the radiated pattern will be circular and not linear. A printed circuit board spiral antenna may not meet the high power handling requirements. Also, the spiral antenna can have a very broad antenna pattern, which can cause the illuminated area to be larger than the dish size for the desired frequency of operation. Log periodic feed elements can have non-constant phase centers, which can result in a variation of the focus of the dish with frequency. Dish antennas with a waveguide feed design can be limited by the single mode bandwidth of the waveguide (i.e. the antennas do not have a wide bandwidth). Horn antennas can have constant phase centers; but, at the lowest frequencies of operation they may have a large physical size and can block a significant portion of the center of the dish, reducing the effective aperture and gain.

In view of the above, it is an objective of the present invention to provide a tapered slot feed for a dish antenna that can operate satisfactorily over a very wide bandwidth. Another objective of the present invention is to provide a tapered slot feed for a dish antenna that operates with a relatively constant fixed phase center over the entire bandwidth of operation. An additional object of the present invention is to provide a antenna having a tapered slot feed that allows for a combination of high power handling and very wide frequency band width, when compared to the feed elements in the prior art. Still another objective of the present invention is to provide a tapered slot feed for a dish antenna with a beam pattern that matches the dish size over a wide range of operation. Yet another object of the present invention is to provide a tapered slot feed for a dish antenna that can operate in a continuous wave mode at high power.

SUMMARY OF THE INVENTION

A dish antenna adapted for continuous illumination over a broadband frequency range, and methods of operation, can include a parabolic dish having a diameter D and a radius of curvature that establishes a focal point for the parabolic dish. A tapered slot element having a feed point can be positioned relative to the parabolic dish so that its feed point is spaced apart from the center of said parabolic dish by a distance F, which can further be coincident with the parabolic dish focal point. The tapered slot can be defined by two conductive metal components.

The tapered slot feed cannot be the conventional printed circuit design because of the power requirements. The two tapered slot feed components (elements) can be closely spaced at the feed point. The two components then flare out from each other following a smooth curve which could be exponential. The exponential curves slot surfaces can define the tapered slot. The elements can be formed from metal plates whose thickness is controlled by the separation of the two plates from each other to meet the required feed impedance and result in a very low voltage standing wave ratio (VSWR) for the antenna. Unfortunately, even a well designed tapered slot feed will rapidly deteriorate at the lowest frequency as the RF currents fail to follow the original transmission path and instead flow perpendicular to the feed. This can cause the low frequency phase center to miss the focal point of the dish by the entire length of the feed. The unique capability of the feed of the present invention to prevent this is established by a cross slot bar that is critically located to move the phase center back to the focal point at the lowest frequency. It is connected in such a way as to do this without affecting the rest of the frequency band. This conductive bar interconnects the two elements, in order to keep the phase center roughly constant over the entire range of operation.

BRIEF DESCRIPTION OF THE DRAWINGS

The novel features of the present invention will be best understood from the accompanying drawings, taken in conjunction with their accompanying descriptions, in which similarly-referenced characters refer to similarly-referenced parts, and in which.

DETAILED DESCRIPTION OF THE EMBODIMENTS

Figure 1:
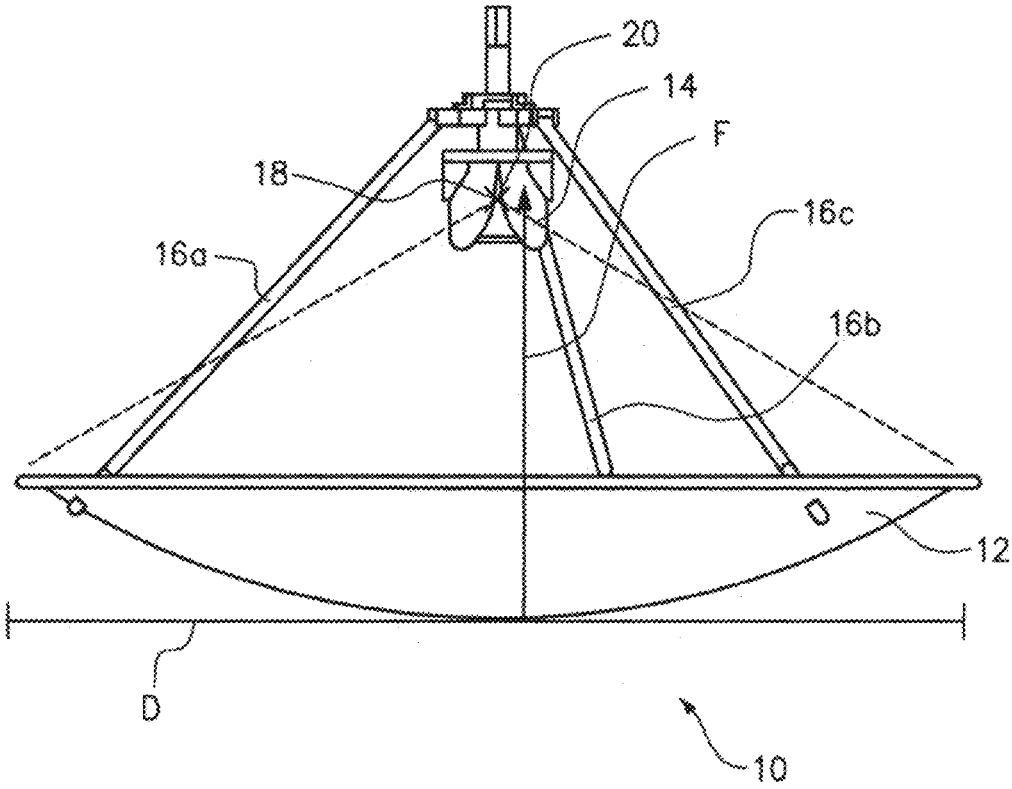
FIG. 1 is a side view of a dish antenna having a tapered slot feed, in accordance with several embodiments of the present invention.
Figure 2:
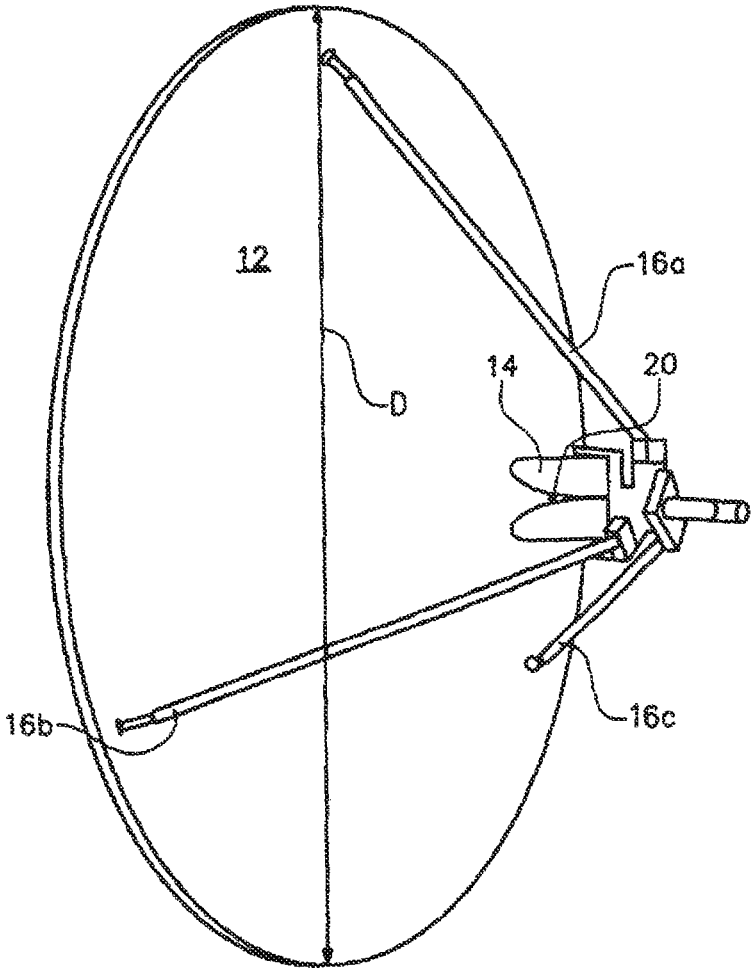
FIG. 2 is a side elevational view of the dish of FIG. 1.

Referring initially to FIGS. 1 and 2, a dish antenna having a tapered slot feed, in accordance with several embodiments of the present invention, can be shown and can be designated by reference character 10. As shown, the antenna 10 can include a parabolic dish 12 and a tapered slot feed 14 that is supported by a plurality of support rods 16*a*, 16*b* and 16*c*. The parabolic dish 12 has a diameter D and radius of curvature that establishes a focal point for the parabolic dish 12, which is designated by reference character 18 at a distance F from parabolic dish 12. F is the focal length for dish 12. In several embodiments, the tapered slot feed can be oriented so that a feed point 20 for the tapered slot feed 14 is spaced apart from the parabolic dish 12 and is located at focal point 18 so that focal point 18 for tapered slot feed 14 and feed point 20 are coincident, as shown in FIG. 1. The structure of the tapered slot feed, as well as the relationship between F and D, can be described more fully below.

Parabolic dish 12 can have a relatively long focal length f (i.e., parabolic dish 12 can have a shallow radius of curvature), within the available space for the dish; this makes the parabolic dish 12 less sensitive to non-constant phase center in several embodiments. For parabolic dish 12 having a diameter D of about 42 inches (D=42) and F of about 16 inches (F=16), the total angular width of the dish is 133.10°. Above 3 GHz, tapered slot antenna 19 can have a 3 dB beam width less than 133°. At the highest frequencies, the 3 dB beam width could be less than 30°. Below 5.7 GHz, the side lobes are outside the dish angular width. From 5.7 GHz to 9.0 GHz the pattern incident on the dish has null and side lobes with a negative sign. These side lobes are down 10 dB. Above 9.0 GHz any nulls and side lobes are inside the dish capture angle for the parabolic dish 12, but these side lobes are more than 10 dB below the main lobe and will not cause any deterioration of the dish antenna's patterns. Thus, the antenna 10 of the present invention according to several embodiments can have an acceptable radiation pattern over a wide bandwidth (such as from 3-18 GHZ).

Figure 3:
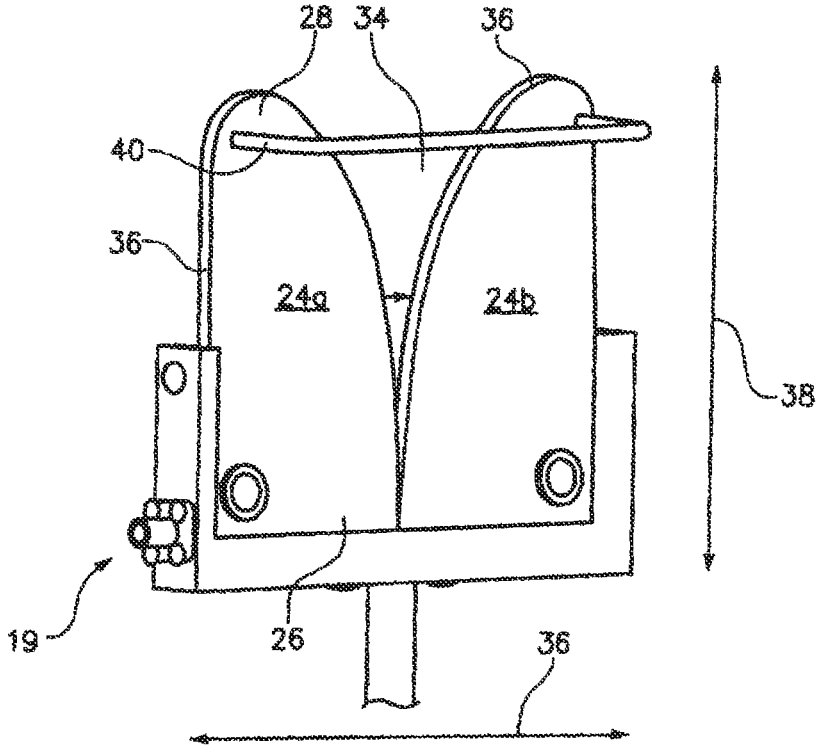
FIG. 3 is a side view of the tapered slot feed for the antenna of FIG. 1.

Referring now to FIG. 3, tapered slot feed 14 according to several embodiments can be described in greater detail. Tapered slot feed 14 can allow the antenna to transmit over a greater bandwidth and can help generate a beam pattern that matches the design size of parabolic dish 12. During operation, a tapered slot feed illuminating a parabolic dish having diameter D=42 inches can handle 250 W continuous wave or peak power. As shown, tapered slot feed 14 can include feed elements 24*a*, 24*b*, with each tapered feed element 24 having a proximal portion 26 and a distal portion 28, as well as a straight edge 30 and an exponential edge 32. The exponential edges 32 of the feed elements cooperate to establish a tapered slot 34 for the tapered slot feed, with the tapered slot having an increasing width from a minimum width at said proximal portion 26 to a maximum width at the distal portion 28 of the tapered slot feed 14.

An aspect ratio for the tapered slot feed can be defined as the ratio of distance 36 from the straight edges 30*a* and 30*b* of feed elements 24*a* and 24*b* over the distance 38 of from the extreme proximal portion 26 to the extreme distal portion 28, as shown in FIG. 3. For several embodiments, the aspect ratio can be 1:1, although other aspect ratios could be chosen according to appropriate design parameters. The thickness of feed elements 24*a*, 24*b* can be determined according to design voltage standing wave ratio (VSWR) constraints for the antenna.

The tapered slot element can further include a conductive bar 40, which is fastened to feed elements 24 in distal portion 28 of feed elements 24, as shown in FIG. 3. Conductive bar 40 can be attached to feed elements distal to phase center, which is further coincident to the feed point 20 for the tapered slot feed. The conductive bar allows the phase center of the feed element to move back to the focal point 18 (as well as feed point 20) at the lowest frequency without affecting the rest of the frequency band. This keeps the phase center roughly constant over the entire range of operation.

During operation of the antenna 10, the phase center of feed element 14 has a small variation. The highest frequencies radiate near feed point 20; the lower frequencies radiate further away from this feed point. The lowest frequencies radiate near conductive bar 40. The highest frequencies propagate as a spherical wave front as soon as they reach their radiation point and radiate from feed element 14. The lower frequency currents propagate on the exponentially curved edge 32 a greater distance before reaching their radiation point and radiating away from feed element 14 as a spherical wave front. This can cause the focus of the dish antenna with the feed to vary with frequency, but this will not be a significant problem due to the short length of the feed and the relatively long focal length of the dish.

Figure 4:
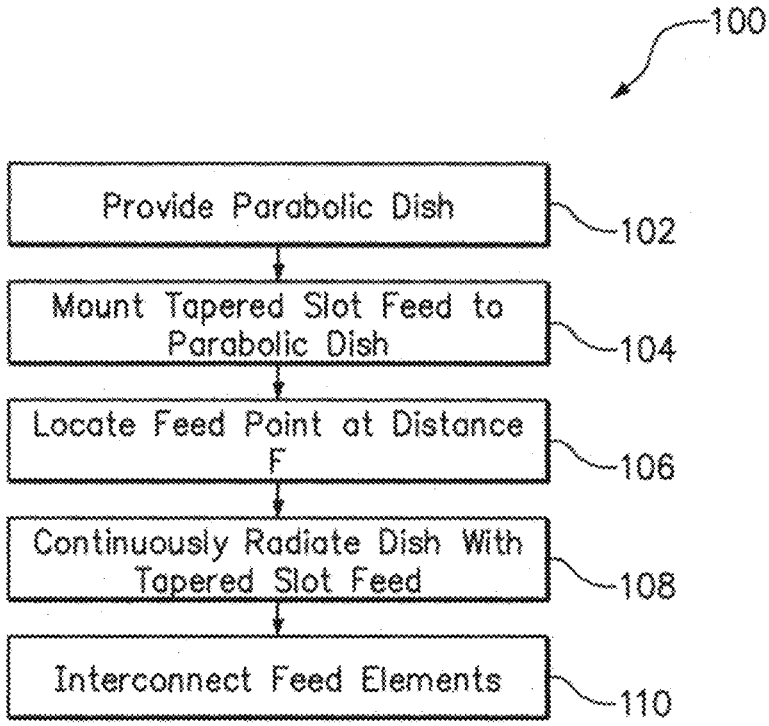
FIG. 4 is a block diagram which can be used to describe the methods of the present invention according to several embodiments.

Referring now to FIG. 4, a block diagram 100 showing the steps that can be taken to practice the methods according to several embodiments is shown. As shown, method 100 can include the initial step 102 of providing a parabolic dish. A tapered slot feed can then be mounted, as indicated by step 104 of FIG. 4. The tapered slot feed can have the structure as described above for several embodiments.

The methods according to several embodiments can also include the step (indicated by block 106) of locating the feed point for the tapered slot feed at a focal distance F from the parabolic dish 12. The focal distance F is determined by the curvature of parabolic dish 12. It should be mentioned that while for several embodiments the diameter can be selected, for other embodiments, it cannot be selected. For example, in some embodiments, it may necessary to convert a narrowband antenna that has already been installed on a platform, such as a naval vessel, to broadband operation. For these instances, the size footprint of the antenna (particularly the parabolic dish diameter D and curvature) has already been determined by the previous installation. Thus, in many cases, the diameter D is predetermined and step 106 is accomplished so that the feed element is located at the focal point of the dish as described above.

Once the tapered slot feed has been located at a focal distance F from the parabolic dish, the parabolic dish can be continuously radiated with the tapered slot feed, as indicated by step 108. Optionally, a conductive bar 40 having the structure described above can be fastened to the feed elements 24 of the tapered slot feed, as shown in step 110 in FIG. 4. The conductive bar can prevent the movement of the phase center at low frequency during operation, which further facilitates broadband operation of the antenna.

The use of the terms "a" and "an" and "the" and similar references in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An antenna adapted for continuous illumination over a broadband frequency range, said antenna comprising:

a parabolic dish, said parabolic dish having a diameter D and a radius of curvature that establishes a focal point for said parabolic dish;

a tapered slot feed having a feed point, said tapered slot feed being positioned so that said feed point is spaced-apart from said parabolic dish by a distance F, said tapered slot feed further having at least two elements that are spaced apart to define a tapered slot;

wherein each of said at least two elements has a straight edge and an exponential edge, and wherein said at least two elements are oriented so that said exponential edges define said tapered slot;

wherein said tapered slot has a phase center that is substantially coincident with said feed point; and, a conductive bar interconnecting said at least two elements distal to said phase center.

2. The antenna of claim 1 wherein said focal distance feed point is coincident with said focal point.

3. The antenna of claim 2 wherein said broadband frequency range is from one to 18 gigahertz (1-18 GHz), said diameter D is 42 inches and said ratio F/D is 0.381.

4. The antenna of claim 1, wherein each of said at least two elements has a proximal portion and a distal portion, and further wherein said tapered slot feed has an increasing exponential taper from a minimum width at said proximal portions to a maximum width at said distal portions.

5. A method for broadband operation of a dish antenna comprising the steps of:

A) providing a dish, said dish having a diameter D and a radius of curvature that establishes a focal point for said parabolic dish;

B) establishing a tapered slot feed above said dish, said tapered slot feed having a feed point and at least two elements, said at least two elements being spaced-apart to define a tapered slot with a phase center;

said tapered feed slot from said step B) having at least two elements, each of said at least two elements having a straight edge and an exponential edge, said at least two elements being oriented so that said exponential edges define said tapered slot;

each of said at least two elements from said step B) having a proximal portion and a distal portion, said tapered slot feed from said step B) having an increasing exponential taper from a minimum width at said proximal portions to a maximum width at said distal portions;

C) locating said feed point at a distance F from said dish, said feed point being coincident with said phase center;

D) continuously radiating said dish with said tapered slot feed; and

E) interconnecting said at least two elements distal to said phase center with a conductive bar.

6. The method of claim 5, wherein said step A) is accomplished with a parabolic dish having a diameter D that is 42 inches, and said step C) is accomplished so that F/D is less than 0.381, and said step D) is accomplished in a broadband frequency range from one to eighteen gigahertz (1-18 GHz).

7. The method of claim 5, further comprising the step of:

F) illuminating said dish with a continuous wave radiation from said tapered slot feed.

* * * * *